US005997056A

United States Patent [19]

Yamagishi

[11] Patent Number: 5,997,056

[45] Date of Patent: Dec. 7, 1999

[54] LOCKING DEVICES

[75] Inventor: Masahiro Yamagishi, Tokyo, Japan

[73] Assignee: Tokyo Magnet Ohyo Seihin Kabushiki Kaisha, Tokyo, Japan

[21] Appl. No.: 09/015,318

[22] Filed: Jan. 29, 1998

[30] Foreign Application Priority Data

Feb. 14, 1997 [JP] Japan ..... 9-030126

[51] Int. Cl.[6] ..... E05B 15/02

[52] U.S. Cl. ..... 292/341.17; 292/DIG. 4; 292/49; 292/6; 292/DIG. 72

[58] Field of Search ..... 292/DIG. 4, 6, 292/45, 56, 71, 74, 75, 78, 79, 63, 64, 137, 157, 163, 146, 214, 220, 198, 216, 341.17, 49, DIG. 72

[56] References Cited

U.S. PATENT DOCUMENTS

| | | | |
|---|---|---|---|
| 1,236,255 | 8/1917 | Bond | 292/78 |
| 2,772,106 | 11/1956 | Semelka | 292/18 |
| 3,322,451 | 5/1967 | Bredemus | 292/137 |
| 4,036,517 | 7/1977 | Talmadge | 292/216 |
| 4,482,175 | 11/1984 | Sugie | 292/45 |
| 4,702,506 | 10/1987 | Iimura | 292/251.5 |
| 4,709,949 | 12/1987 | Umezawa et al. | 292/6 |
| 5,072,974 | 12/1991 | Henne | 292/126 |
| 5,292,158 | 3/1994 | Kurosaki | 292/45 |

FOREIGN PATENT DOCUMENTS 181376 11/1962 Sweden .

574474 1/1946 United Kingdom .

*Primary Examiner*—Darnell M. Boucher
*Assistant Examiner*—John B. Walsh
*Attorney, Agent, or Firm*—Liniak, Berenato, Longacre & White

[57] ABSTRACT

A locking device for opening or closing a door comprising a lock housing having a pair of holes formed in the front surface thereof; a slider which can slide within the lock housing; a pair of clamps, the base end of each of which is pivotally mounted on the front end of the slider, and the other end of each of which has a spring force acting outward, and the both ends of which are pushed from outward to inward in the direction where the both ends are compressed when the clamps go backward within the lock housing; a spring member for the clamps attached to the front end of the slider such that said pair of clamps are opened in an approximately V-shape; a spring member for the slider which is intervened between said lock housing and said slider and which applies a spring force to said slider in the direction forward to the hole of the lock housing; a heart-shaped groove which is carved in one side of said slider, has a plurality of differences in depth, and a recess provided on the bottom portion of the heart shape; a projecting member, one end of which can slide within the groove only in one direction, and the other end of which is formed on an appropriate position of the lock housing; and a key unit having a spherical member, which can be clamped by the pair of clamps is provided.

4 Claims, 5 Drawing Sheets

LOCKING DEVICES

BACKGROUND OF THE INVENTION

1. Field of the Invention

The present invention relates to a locking device for opening or closing a door which is used in kitchen furniture and the like.

2. Prior Art

In conventional, there is a locking device for opening or closing a door, for example, as described in Japanese examined Utility Model Publication 2-2857 (corresponding to U.S. Pat. No. 4,482,175). The locking device disclosed therein comprises a lock housing 31 formed in a cabinet A for kitchen furniture and a key unit 32 formed in a door B as shown in FIG. 5. The lock housing 31 and the key unit have the relation to be fitted with each other and to be released. The lock housing 31 of the cabinet 33 has a pair of holes formed in the surface thereof in which a slider which can be moved 35 is accommodated. At the front end of the slider 35, a pair of clamps 36 and 36 which can revolve are supported. A spring member (not shown) is provided so that it is applied to a spring force to open the front ends of the clamps 36 and 36 in a V shape. At the same time, a heart-shaped groove 37 is provided on the side of the slider. A projecting member 38, one end of which slides within the slider only in one direction is provided, and the other end is formed on an appropriate position of the cabinet 33, is applied to a spring force in the direction of groove 37 by a leaf spring 39.

Consequently, when the door B in the closed state is opened, the clamps 36 and 36, which are opened in the rear surface of the door in a V shape, are brought into contact with each other in the state where a spherical member 42 of the key unit is intervened between the clamps. When the door B is further pushed toward the direction of the cabinet A, the clamps 36 and 36 are guided by rails 43 and 43 to be pushed toward inward. The clamps 36 and 36 then revolve in the direction where the open ends thereof are closed, and they clamp the spherical member 42 and move toward the direction of the cabinet A. At this time, the front end of the projecting member 38 residing within the heart-shaped groove is positioned at the recess via one side of the groove 37 to the top of the groove, and inhibits the slide of the clamps 36 and 36. The door B is locked on the cabinet A in this state.

The locking device as described above in which the leaf spring 39 is used to apply a spring force to the heart-shaped groove is disadvantageous in terms of the durability in that when the number of using the lock device is increased, the resiliency of the spring force becomes poor.

Furthermore, when the door is further pushed, the front ends of the clamps 36 and 36 are opened in a V-shape by a spring force of the spring provided on the base ends of the clamps 36 and 36 whereby the slider 35 and the clamps 36 and 36 move forward to release the locking state in the locking device disclosed therein. However, the movement is due to a spring force of the spring provided on the base ends of the clamps 36 and 36, it is difficult to smoothly move the slider 35 and the clamps 36 and 36 forward, and their actions tend to be slow.

Still further, the rollers 43 and 43 must be provided within the cabinet 33 of the locking housing 31, making the mechanism of the locking housing 31. For this reason, the device becomes a large size, and it is difficult to produce the device in a small size.

Moreover, it is difficult to correctly fix the spherical member 42 of the key unit 32 in the door side at the position opposite to the lock housing 31 and, thus, there is a tendency to have some gaps between the positions of the lock housing 31 and the key unit 32.

SUMMARY OF THE INVENTION

An object of the present invention is, therefore, to provide a locking device for opening or closing a door which can open or close a door only by pushing the door with one touch of one's finger, which has an enhanced durability, which is made of a small parts to simplify the mechanism, i.e., capable of being produced into a small size, and which is composed such that even when some gaps are generated, they can be automatically corrected, whereby solving the problems associated with the prior art.

The present invention, which has been achieved in light of the circumstances described above, relates to a locking device for opening or closing a door, which comprises a lock housing having a pair of holes formed in the front surface thereof; a slider which can slide within the lock housing; a pair of clamps, the base end of each of which is pivotally mounted on the front end of the slider, and the other end of each of which has a spring force acting outward, and the both ends of which are pushed from outward to inward in the direction where the both ends are compressed when the clamps go backward within the lock housing; a spring member for the clamps attached to the front end of the slider such that said pair of clamps are opened approximately in a V-shape; a spring member for the slider which is intervened between said lock housing and said slider and which applies a spring force to said slider in the direction forward to the hole of the lock housing; a heart-shaped groove which is carved in one side of said slider, has a plurality of differences in depth, and a recess provided on the bottom portion of the heart shape; a projecting member, one end of which can slide within the groove only in one direction, and the other end of which is formed on an appropriate position of the lock housing; and a key unit having a spherical member, which can be clamped by the pair of clamps.

The locking device according to the present invention is also characterized in that slopes for pushing said pair of clamps from outward to inward are provided on the faces each opposite to the corresponding hole of said lock housing.

The locking device according to the present invention is also characterized in that a coil spring is used as the spring member for the slider, and said projecting member is applied to a spring force in the groove direction by a small diameter portion provided on the coil spring.

The locking device according to the present invention is also characterized in that the spherical member of said key lock can move perpendicular to the movement direction within a prescribed range.

PREFERRED EMBODIMENTS OF THE INVENTION

In the following, embodiments of the locking device according to the present invention will now be described by referring to the attached drawings.

Figure 1:
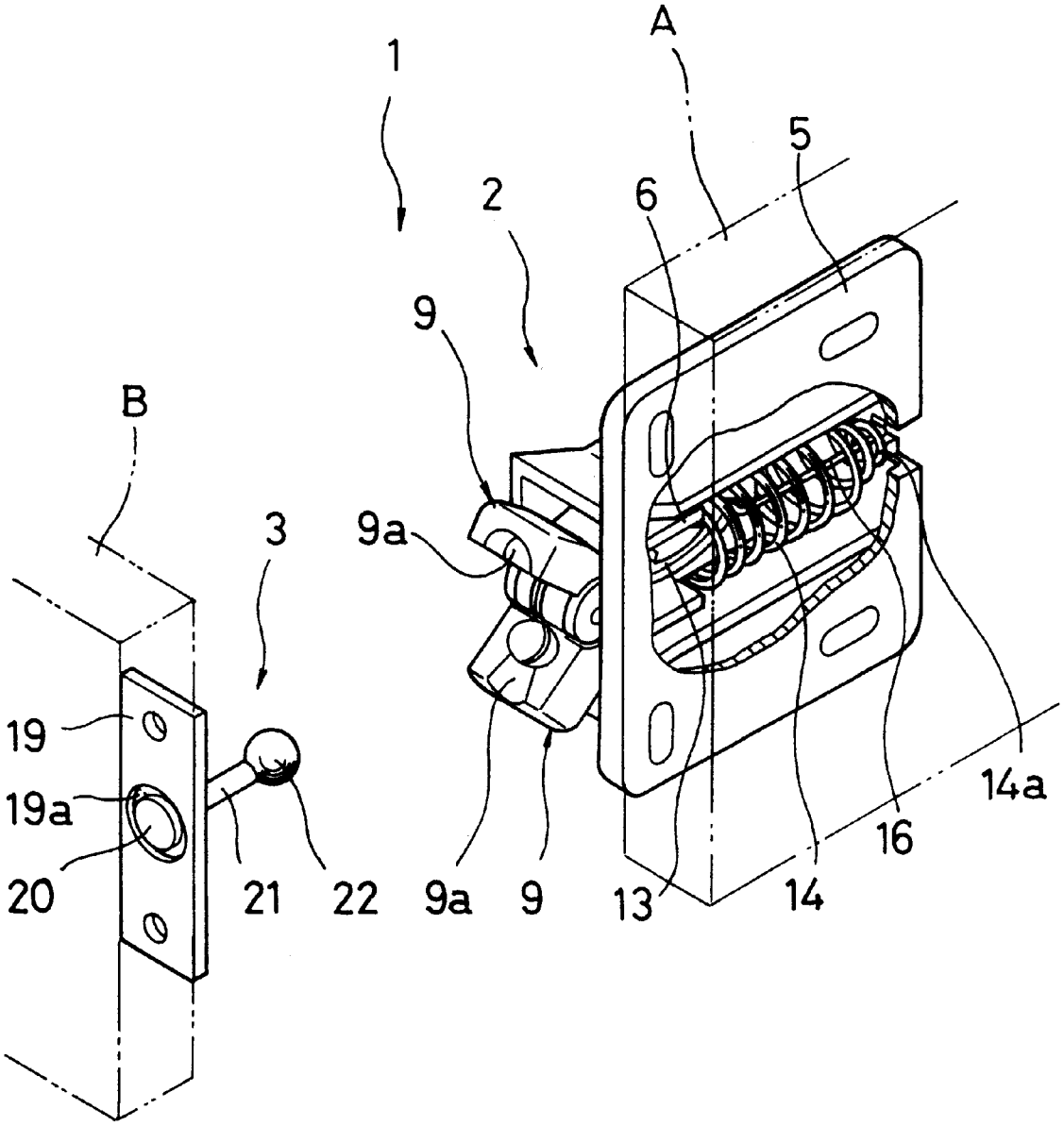
FIG. 1 is a perspective view showing one embodiment of the locking device according to the present invention.
Figure 2:
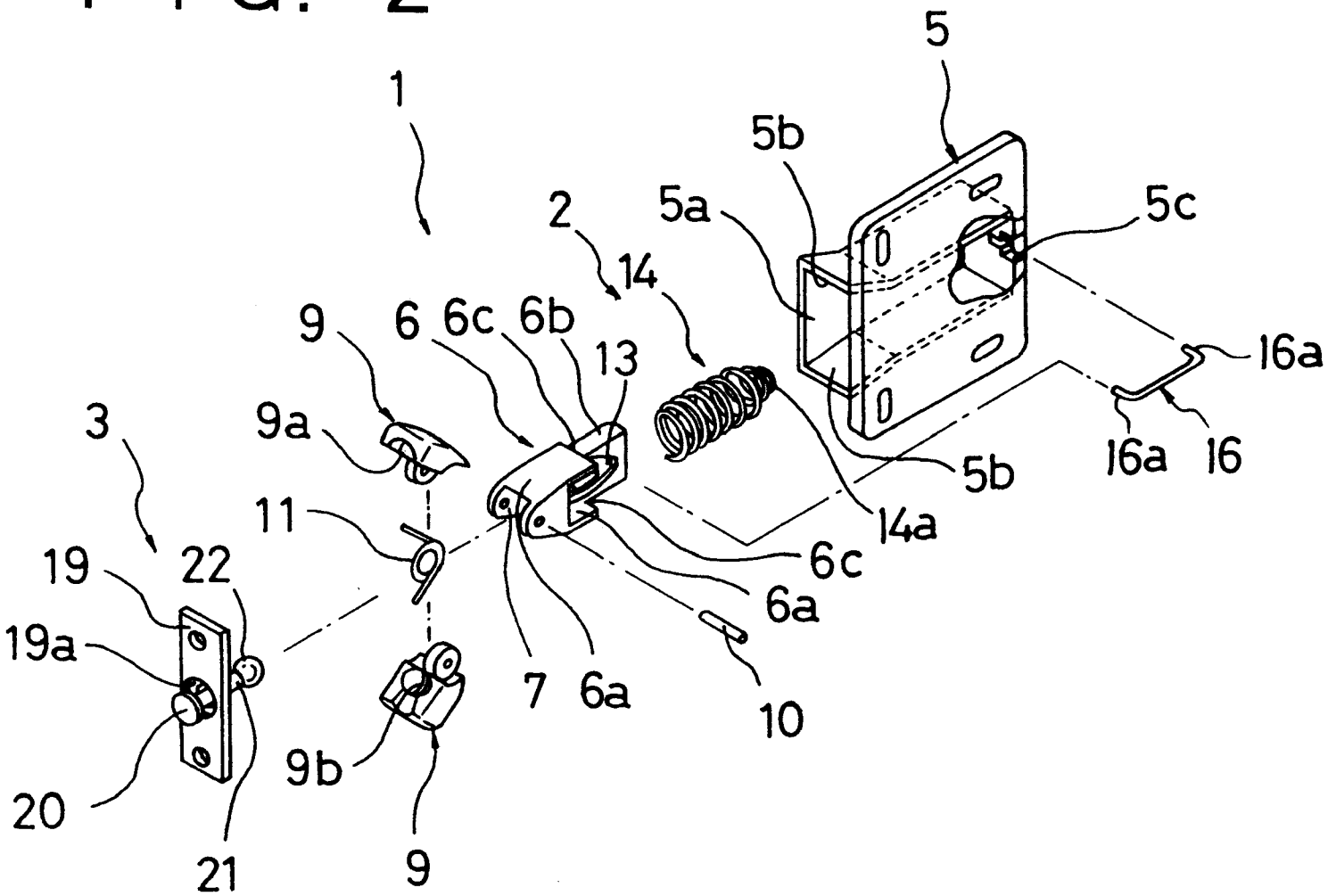
FIG. 2 is an exploded perspective view of FIG. 1.

FIG. 1 is a perspective view showing one embodiment of a locking device according to the present invention, and FIG. 2 is an exploded view thereof. As shown in FIGS. 1 and 2, a locking device 1 for opening or closing a door comprises a locking housing 2 equipped on the side of a cabinet A and a key unit 3 equipped on the side of a door B.

The lock housing 2 has a box case 5 made of a synthetic resin. The front surface of the case 5 is opened, and within the case 5 a slider 6 which can slide in the front and rear directions is stored.

A groove 7 having a substantial circle shape is provided on a front end of the slider. The vertical direction and the front side of the circle groove 7 are opened. The base ends of a pair of clamps 9 and 9 arranged in the vertical direction, which can vertically revolve, are supported via a pin 10 within the groove 7. Dented portions 9*a* and 9*a* and slits 9*b* and 9*b* for supporting each one end of the spring member 11 are provided opposite to the front ends of the clamps 9 and 9.

Guide plates 6*a* and 6*a* are provided on an upper end and a lower end of the slider 6. A side plate 6*b* extending backward is provided on one of right and left sides between the guide plates 6*a* and 6*a*. Portions 6*c* and 6*c* having difference in depth are formed by the rear ends of the guide plates 6*a* and 6*a* and the upper and lower faces of the side plate 6*b*. Furthermore, a heart-shaped groove 13 is carved within the side plate 6*b*.

The case 5 has an open hole 5*a*, slopes 5*b* and 5*b* provided on the upper and lower sides within the open hole 5*a*, and a pore 5*c* or supporting a projecting member 16, which is penetrated through the interior of the rear end. Together with a small groove provided on the side wall in which one end of a bent portion 16*a* of the projecting member 16, the pore 5*c* supports the projecting member 16 which can revolve. Between the pore 5*c* for supporting the projecting member and the portions 6*c* and 6*c* having difference in depth of the slider 6, a coil spring 14 are compressed.

The projecting member has a U-shape and possesses bent portions 16*a* and 16*a* at the both ends thereof. The bent portion 16*a* at one end is supported by the supporting member 5*c* for supporting a projecting member so as to freely revolve, and the bent portion 16*a* at the other end is always in contact with the heart-shaped groove by the spring force of the coil spring 14.

Figure 3A:
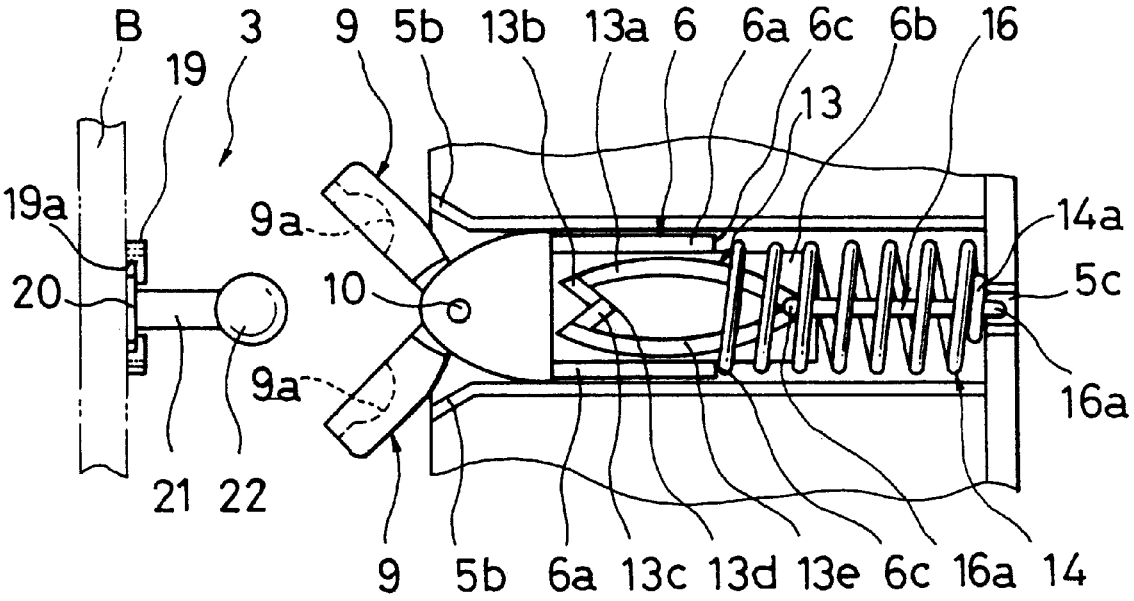
FIG. 3 is a view explaining the action of the locking device according to the present invention, wherein FIG. 3(*a*) shows the lock housing and the key unit in the state where the door is opened, and FIG. 3(*b*) shows the lock housing and the key unit where the door is closed.
Figure 3B:
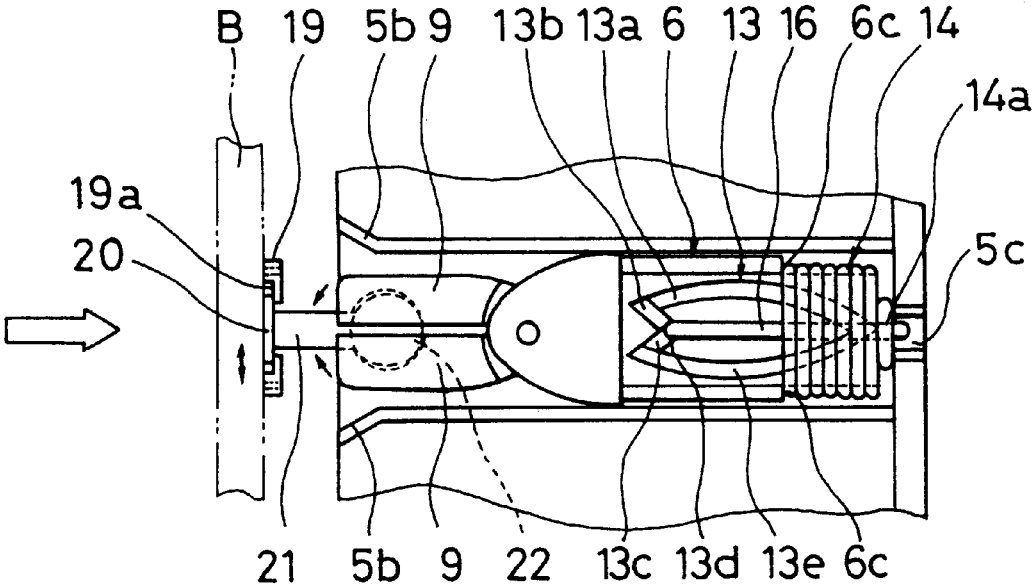

As shown in FIG. 3, the heart-shaped groove 13 is formed from a top portion 13*a*, a pair of slopes, i.e., downward slope 13*b* and an upward slope 13*c*, recess 13*d* which is a bottom of the slopes, and bottom portion 13*e*. There are difference in depth from the rear end of the top portion 13*a* to the front end of the bottom portion 13*e*, from the top portion 13*a* to the downward slope 13*b*, from the downward slope 13*b* to the recess 13*d*, and from the upward slope 13*c* to the bottom 13*e*. There is no difference in depth between the recess 13*d* and the upward slope 13*b*. The depth in the bottom portion 13*e* is gradually decreased from the front end to the rear end. There is also difference in depth between the rear end of the bottom portion 13*e* to the rear end of the top portion 13*a* so that the depth in the bottom portion side is deep. Consequently, due to the differences in depth described above, the bent portion 16*a* of the projecting member 16 can slide in the direction of from the top portion 13*a*, the downward slope 13*b*, recess 13*d*, the upward slope 13*c*, the bottom portion 13*e*, to the top portion 13*a*, but it cannot slide in the reverse direction.

On the other hand, as shown in FIGS. 1 and 2, a key unit 3 is mounted at the position opposite to the lock housing 2 residing on the rear surface of the door B of kitchen furniture. The key unit 3 has a base plate 19 to be installed to the door B. The base plate 19 has a circular groove 19*a* at the center portion thereof. The circular groove 19*a* has a penetrating pore. Further, a disk 20 having a diameter smaller than that of the circular groove 19*a* is slidably fitted within the groove 19*a* of the base plate 19. A rod 21 having a diameter smaller than the penetrating pore of the circular groove 19*a* is mounted on the disk 20. On the front end of the rod 21, a spherical member 22 is fixed. Accordingly, the disk 20, the rod 21, and the spherical member 22 can be moved within the penetrating pore of the circular groove 19*a*, making it possible to automatically correct the position of mounting the key unit 3 and the lock housing 2, even if the positions to be communicated have some gaps.

Next, the action of the locking device for opening or closing a door according to the present invention will be described by referring to FIG. 3.

FIG. 3(*a*) shows the lock housing and the key unit 3 which are opened. The slider 6 and the clamps 9 and 9 are at forward position by the action of the coil spring 14. The front ends of the clamps 9 and 9 are opened by the spring 11, and the bent portion 16*a* of the projecting member 16 resides backward to the top portion 13*a* of the heart-shaped groove 13.

As shown in FIG. 3(*b*) , when the door B in the open state is closed, the spherical member 22 of the key unit 3 pushes the base end of the clamps 9 and 9 whereby the clamps 9 and 9 and the slider 6 move backward. According to the movement, the clamps 9 and 9 are guided by the slopes 5*b* and 5*b* and pushed from inward to outward directions respectively, and compress the open end thereof to clamp the spherical member 22 by the dented potions 9*a* and 9*a*. At the same time, the bent portion 16*a* of the projecting member 16 slides to the recess 13*d* of the heart-shaped groove 13 via the top portion 13*a* and the downward slope 13*b*, so that the bent portion 16*a* of the projection member 16 is locked at the position of the recess 13*d* by the resilient force. In this state, the door B is locked. In this case, the projecting member 16 is always applied to a spring in the direction of the heart-shaped groove 13 by the small diameter portion 14*a* of the spring coil 14.

On the other hand, since the disk 20, the rod 21 and the spherical member 22 of the key unit 3 can slide perpendicular to the direction of the movement of the spherical member 22, it is possible to automatically correct the position of mounting the key unit 3 and the lock housing 2, even if the positions to be communicated have some gaps.

When the door B in the closed state is further pushed, the bent portion 16*a* of the projecting member 16 is moved to the bottom portion 13*e* of the heart-shaped groove 13 via the recess 13*d* and the upward slope 13*c*. By the resilient force of the coil spring 14, the slider 6 and the clamps 9 and 9 go forward. According to this movement, the front ends of the clamps 9 and 9 are released to cancel the communication relationship with the spherical member 22, i.e., to cancel the locking and to return to the state shown in FIG. 3(*a*) whereby the door B becomes an open state. In this case, the bent portion 16*a* of the projecting member 16 slides from the recess 13*d* of the heart-shaped groove 13 to the rear end of the top portion 13*a* via the upward slope 13*c* and the bottom portion 13*e*, and stops at this position.

Consequently, since a leaf spring is not used as in the conventional device for applying the spring force to the projecting member 16, but the small diameter portion 14*a* of the coil spring 14 is used, the resiliency and durability can be improved in comparison with the use of a leaf spring.

Moreover, since a pair of rollers in order to push the pair of clamps from inward to outward and a leaf spring for applying a spring force to the projecting member are not required in the locking device, the parts to be used are decreased, accordingly making the mechanism simplify, the device becoming hard to break down and it being possible to make the device in a small scale.

A second embodiment of the present invention in which some alternation has been made will now be described by referring to FIG. 4.

Figure 4:
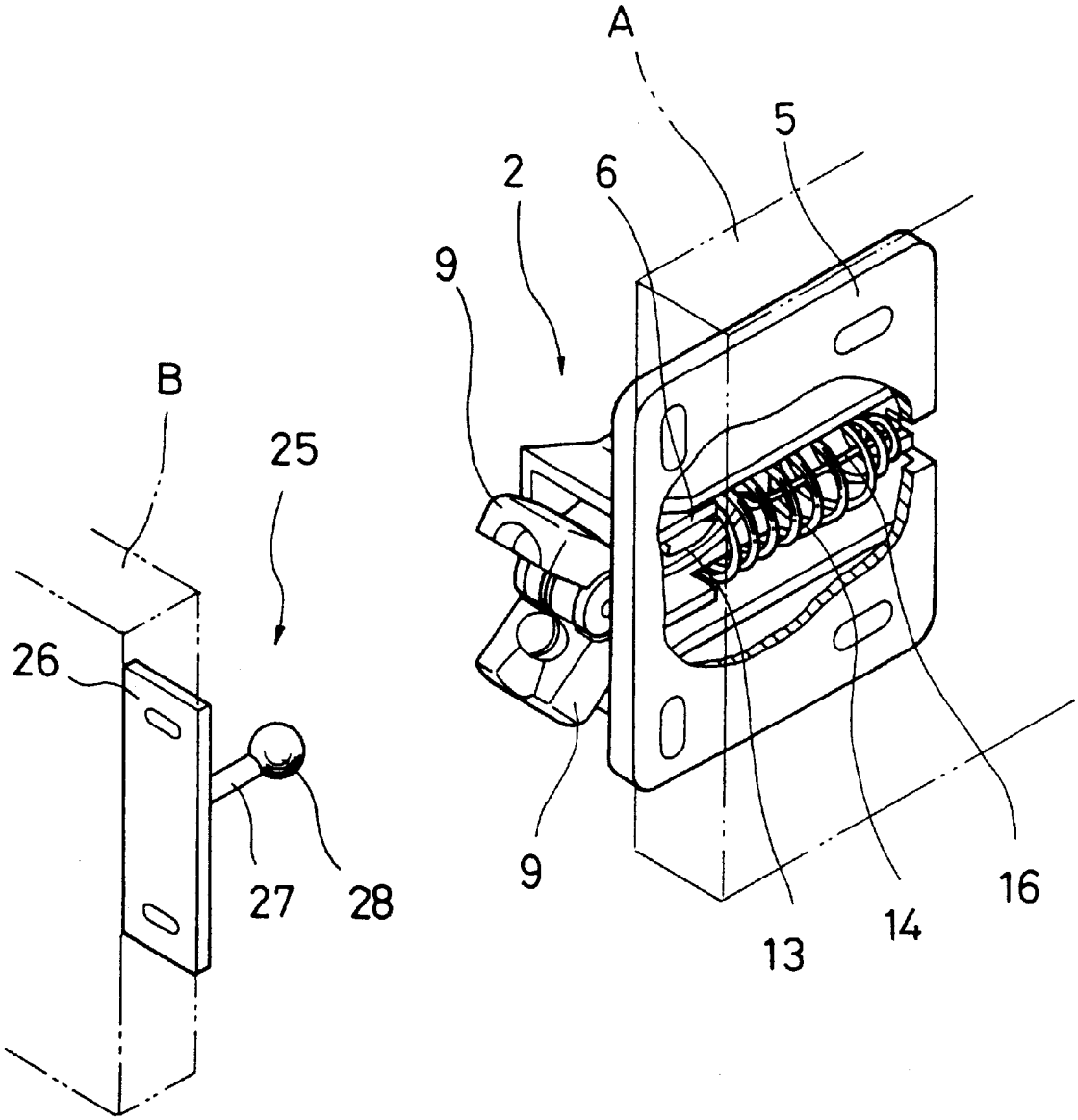
FIG. 4 is a perspective view showing another embodiment of the locking device of the present invention.
Figure 5:
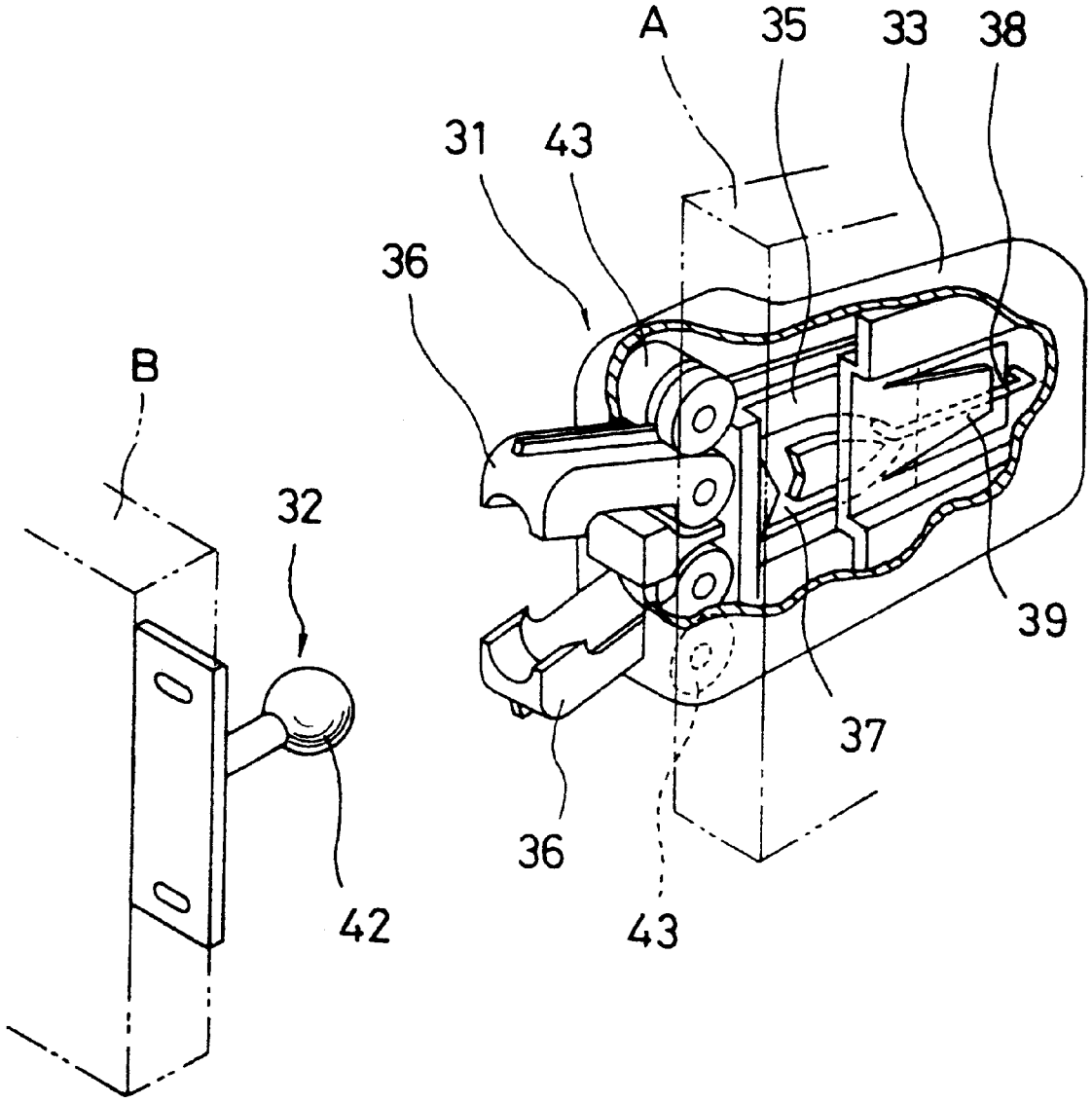
FIG. 5 (Prior Art)
FIG. 5 is a perspective view showing a locking device according to the prior art.

FIG. 4 shows a perspective view showing a locking device for opening or closing a door comprising a lock housing and a key unit in which a spherical member is fixed. To the rear surface of a door B for the kitchen furniture, a key unit 26 is attached. The key unit 25 has a base plate 26 for mounting the key unit to the door B. A rod 27 is provided on the base plate 26, a spherical member 28 is provided on the front end of the rod 27, and otherwise, the lock housing is composed similar to the first embodiment described above.

Although the spherical member 28 does not move perpendicular to the direction of the movement of the spherical member, it is possible to use a larger rod 27 and a larger spherical member 28. For this reason, the device is hard to become rickety and the key unit can be communicated with the lock housing more firmly to lock the door B.

Whereas the locking devices for opening or closing a door in the first and second embodiments described above are applied to a door for kitchen furniture, the device of the present invention is, of course, applicable to another furniture.

Whereas the locking housing and the key unit of the locking devices in the first and second embodiments are mounted in the vertical direction, they can be, of course, mounted in the horizontal direction.

Further, the project member is applied to a spring force in the groove direction by the small diameter portion of the spring coil in the first and second embodiments, the application is not restricted thereto. For example, the projecting member can be applied by an independent spring member.

As described above, according to the present invention, since there is no need for a pair of rollers for pushing the pair of clamps from inward to outward direction in the lock housing, parts to be used are decreased, simplifying the mechanism, the device becoming hard to break down and, thus, it being possible to make the device in a small scale.

Moreover, since the slopes for pushing the pair of clamps from inward to outward direction are provided opposite to the open holes of the lock housing case, the both front ends of the clamps can be smoothly closed to clamp the spherical member thereby locking the door.

Furthermore, since a leaf spring is not used for applying the projecting member in the groove direction as in the conventional case but the small diameter portion provided on one end of the coil spring is used, the resiliency and durability can be improved in comparison with the case of the leaf spring.

Still further, since the spherical member of the key unit can move perpendicular to the movement of the spherical member, gaps, even if being generated, can be automatically collected. For this reason, the locking device can act with more reliability and more smoothness.

What is claimed is:

1. A locking device for opening or closing a door, which comprises:

a lock housing having at least one opening formed in the front surface thereof;

a slider which can slide within the lock housing;

a pair of clamps, the base end of each of which is pivotally mounted on the front end of the slider, and the other end of each of which has a spring force acting outward, and the both ends of which are pushed from outward to inward in the direction where the both ends are compressed when the clamps go backward within the lock housing;

a spring member for the clamps attached to the front end of the slider such that said pair of clamps are opened in an approximately V shape;

a pair of slopes for pushing said pair of clamps from outward to inward are provided on the faces each opposite to the corresponding opening of said lock housing;

a heart-shaped groove which is carved in one side of said slider, has a plurality of differences in depth, and a recess provided on the bottom portion of the heart shape;

a projecting member, one end of which can slide within the groove only in one direction, and the other end of which is disposed at an appropriate position of the lock housing;

a second spring member for the slider located between the lock housing and said slider to push said slider toward the opening of the lock housing, said second spring member being a coil spring;

said other end of said projecting member receiving a resilient force from a small diameter portion provided on said second spring member;

a key unit having a spherical member, which can be sandwiched between the pair of clamps.

2. The locking device as claimed in claim 1, wherein the spherical member of said key lock can move perpendicular to the movement direction within a prescribed range.

3. The locking device as claimed in claim 1, wherein said pair of clamps both pivot about a common pivot axis.

4. The locking device as claimed in claim 1, wherein said small diameter portion of said second spring member provides a resilient force to maintain a position of said projecting member within said groove.

* * * * *